United States Patent [19]

Dougherty et al.

[11] Patent Number: 4,840,596

[45] Date of Patent: Jun. 20, 1989

[54] FACTORY FIXTURE FRAME WITH MEANS FOR TEMPORARILY AND REMOVABLY SUPPORTING AN IN-PROCESS TENSION MASK FOR A COLOR CATHODE RAY TUBE

[75] Inventors: Lawrence W. Dougherty, Sleepy Hollow; James L. Kraner, Barrington, both of Ill.

[73] Assignee: Zenith Electronics Corporation, Glenview, Ill.

[21] Appl. No.: 139,997

[22] Filed: Dec. 31, 1987

[51] Int. Cl.[4] ..... H01J 9/00

[52] U.S. Cl. ..... 445/30; 269/254 R; 269/254 D; 24/462; 160/371

[58] Field of Search ..... 445/30, 37, 52; 313/407; 269/254 R, 254 D; 24/462; 160/371; 140/109; 101/415.1

[56] References Cited

U.S. PATENT DOCUMENTS

| | | | |
|---|---|---|---|
| 582,504 | 5/1897 | Keene | 269/254 R |
| 2,417,149 | 3/1947 | Beaton | 269/254 R |
| 2,565,218 | 8/1951 | Freeborn | 101/415.1 |
| 2,625,734 | 1/1953 | Law . | |
| 2,654,940 | 10/1953 | Law . | |
| 2,925,774 | 2/1960 | Scheeler | 101/415.1 X |
| 3,894,321 | 7/1975 | Moore . | |
| 4,069,567 | 1/1978 | Schwartz | 29/447 |
| 4,547,695 | 10/1985 | Rath | 313/407 |
| 4,547,696 | 10/1985 | Strauss . | |
| 4,591,344 | 5/1986 | Palac . | |
| 4,593,224 | 6/1986 | Palac . | |
| 4,704,094 | 11/1987 | Stempfle | 445/37 X |
| 4,723,089 | 2/1988 | Palac | 313/407 |

OTHER PUBLICATIONS

Improvements in the RCA Three-Beam Shadow Mask Color Kinescope, by Grimes et al., The IRE, Jan. 1954; decimal classification R583.6.

*Primary Examiner*—Kenneth J. Ramsey

[57] ABSTRACT

A reusable factory fixture frame is disclosed for use in the manufacture of a color cathode ray tube having a flat faceplate and a tensed foil shadow mask. The frame provides for mounting an in-process shadow mask during photoexposure of an in-process faceplate in a lighthouse. The frame includes a generally rectangular frame structure having grooves thereabout for receiving an edge of the shadow mask. Spring-loaded mechanical mask-retaining devices are secured to the side of the factory fixture frame for temporarily and removably supporting the in-process shadow mask in tension in the grooves. The shadow mask is heated and allowed to expand prior to being temporarily and removably supported on the frame, and the shadow mask is allowed to cool and shrink in tension while so being supported to effect tensing of the shadow mask in clamped condition on the frame.

23 Claims, 1 Drawing Sheet

FACTORY FIXTURE FRAME WITH MEANS FOR TEMPORARILY AND REMOVABLY SUPPORTING AN IN-PROCESS TENSION MASK FOR A COLOR CATHODE RAY TUBE

CROSS-REFERENCE TO RELATED APPLICATIONS AND PATENTS

This application is related to but in no way dependent upon copending applications Serial Nos. 583,003, filed Sept. 30, 1983; 646,861, filed Aug. 31, 1984; 758,174, filed July 23, 1985; 831,696, filed Feb. 21, 1986; 894,984, filed Oct. 22, 1986; 947,727, filed Dec. 30, 1986; 051,896 filed May. 18, 1987; 131,968, filed Dec. 10, 1987; 058,095, filed June 4, 1987; 140,019, filed Dec. 31, 1987; and U.S. Pat. Nos. 3,894,321; 4,069,567; 4,547,696; 4,591,344; 4,593,224; and 4,595,857, all of common ownership herewith.

BACKGROUND OF THE INVENTION

1. Field of the Invention

This invention relates to color cathode ray picture tubes, and is addressed specifically to improved factory means and processes for the manufacture of a tube having a tensed foil shadow mask. Color tubes of various types that have a tension foil mask can be manufactured by the process, including those used in home entertainment television receivers. The invention is particularly valuable in the manufacture of medium-resolution, high-resolution, and ultra-high resolution tubes intended for color monitors.

The use of a foil-type flat tensed mask and flat faceplate provides many benefits in comparison to the conventional domed shadow mask and correlatively curved faceplate. Chief among these is a greater power-handling capability which makes possible as much as a three-hold increase in brightness. The conventional curved shadow mask, which is not under tension, tends to "dome" in picture areas of high brightness where the intensity of the electron beam bombardment is greatest. Color impurities result as the mask moves closer to the faceplate and as the beam-passing apertures move out of registration with their associated phosphor elements on the faceplate. The tensed mask when heated distorts in a manner quite different from the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tensed foil shadow mask is a part of the cathode ray tube front assembly, and is located in close adjacency to the faceplate. The front assembly comprises the faceplate with its screen which consists of deposits of light-emitting phosphors, a shadow mask, and support means for the mask. As used herein, the term "shadow mask" means an apertured metallic foil which may, by way of example, be about 0.001 inch or less in thickness. The mask must be supported under high tension a predetermined distance from the inner surface of the cathode ray tube faceplate. This distance is known as the "Q-distance". As is well known in the art, the shadow mask acts as a color-selection electrode, or parallax barrier, which ensures that each of the three electron beams lands only on its assigned phosphor deposits.

The conventional process of depositing patterns of color phosphor elements on the screening surface of a color picture tube faceplate utilizes the well-known photoscreening process. A shadow mask, which in effect functions as a perforated optical stencil, is used in conjunction with a light source to expose in successive steps, three discrete light-sensitive photoresist patterns on the screening surface. The shadow mask is typically "mated" to each faceplate; that is, the same mask is used in the production of a specific tube throughout the production process, and is permanently installed in the tube in final assembly. At least four engagements and four disengagements of the mask, as well as six exposures, are required in the standard screening process. In certain processes, a "Master" may be used for exposing the photoresist patterns in lieu of the mated shadow mask.

2. Prior Art

There have been a number of disclosures of tensed foil masks and means for applying tension to the mask and retaining the mask under tension. Typical of these is the disclosure of Law in U.S. Pat. No. 3,625,734 which addresses the construction of a taut, planar foraminous mask. A foil mask blank is loosely mounted in a two-section frame, and the mask is expanded by the hot-blocking process. Machine screws peripheral to the frame provide for clamping the mask tightly in the frame when the mask is in its expanded state. The mask becomes tensed upon cooling as it is restrained from returning to its former dimensions by its captivation by the frame. The frame with the mask enclosed is mounted with the phosphor-screen as a unitary assembly adjacent to the inner surface of the faceplate. Law in U.S. Pat. No. 2,654,940 also discloses means for stretching and captivating by frames masks formed from wire mesh.

U.S. Pat. No. 3,894,321 to Moore, of common ownership herewith, is directed to a method for processing a color cathode ray tube faceplate in conjunction with a thin foil tension shadow mask. A frame screw-clamp supports a tensed mask during lighthouse exposure of an associated screen. The faceplate is registered with the mask support frame by means of three alignment posts which extend from the lighthouse, and against which the frame and the faceplate are both biased by gravity. The faceplate and frame, being both referenced to the three lighthouse posts, are thereby referenced to each other.

U.S. Pat. No. 4,591,344 to Palac, of common ownership herewith, discloses a method of making a color cathode ray tube in which a frame on which a shadow mask is stretched has indexing means cooperable with registration-affording means on a faceplate. The assembly provides for multiple registered matings of the faceplate and mask during photoscreening operations. A photographic plate is used in a process for applying the phosphor elements to the faceplate screening surface to provide an interchangeable mask system. This in lieu of the more common method of using a shadow mask permanently mated with a faceplate, and which serves as an optical stencil during the photoscreening process. The sealing areas of the faceplate and the frame are joined in a final assembly operation such that the frame becomes an integral constituent of the cathode ray tube.

A mask registration and supporting system for a cathode ray tube having a rounded faceplate with a skirt for attachment to a funnel is disclosed by Strauss in U.S. Pat. No. 4,547,696 of common ownership herewith. The skirt of the faceplate provides the necessary Q-distance between the mask and the screen. A frame dimensioned to enclose the screen comprises first and second spaced-apart surfaces. A tensed foil shadow mask has a peripheral portion bonded to a second surface of the frame. The frame is registered with the faceplate by ball-and-groove indexing means. The shadow mask is sandwiched between the frame and a stabilizing or stiffening member. Following final assembly, the frame is permanently fixed in place within the tube envelope between the sealing lands of the faceplate and a funnel, with a stiffening member projecting from the frame into the funnel.

In U.S. Pat. No. 4,593,224 to Palac, of common ownership herewith, there is disclosed a shadow mask mount in the shape of a rectangular frame for use in tensing an in-process shadow mask, and for temporarily supporting the mask while in tension. An apertured foil comprising the in-process mask is laid across the opening in the frame and is secured to the frame by brazing or welding. The coefficient of thermal expansion of the foil is preferably equal to or slightly less than that of the frame. A glass frame is also provided that consists of two identical rectangular members smaller in circumferential dimension than the metal frame. When joined into a single frame, the members are located between the tube faceplate and funnel to become an integral part of the tube envelope in final assembly. Each member of the glass frame has indexing means, one member for indent-detent registration with the faceplate, and the other for indent-detent registration with the funnel. Following the application of a layer of devitrifying cement in paste form to the facing surfaces of the two members, the mask, held in the metal frame, is sandwiched between the two members. As the assembly is heated, the expansion of the mask is taken up by screw means attached to the metal frame which press against the peripheries of the members. Upon cooling of the assembly, the coefficient of thermal expansion of the mask, being greater than that of the glass, results in the mask being held permanently in tension by the glass frame through the medium of the frit cement, which has become solidified by the heat. The portion of the mask that projects beyond the periphery of the glass frame is severed to release the metal frame. The glass frame with its captivated mask is then mounted on a lighthouse for photoscreening the faceplate, with registration with the lighthouse and faceplate provided by the indent-detent means described.

In referent copending application Ser. No. 831,696 of common ownership herewith, there is disclosed an apparatus for tensing a foil shadow mask. The apparatus comprises a pedestal having registration-affording means, and a tensing structure which includes a fixture comprising a pair of collars for clamping the edge of a foil to support and maintain the foil in a taut condition. An anvil is provided for engaging a peripheral portion of the clamped foil to induce deflection of the foil, and thereby, a predetermined tension in the foil. Following a photoscreening process, the mask is secured to shadow mask supports extending from the faceplate by welding.

In a journal article, there is described means for mounting a flat tensed mask on a frame for use in a color cathode ray tube having a circular faceplate with a curved viewing surface. In one embodiment, the mask, which is also circular, is described as being welded to a circular frame comprised of a ⅛-inch steel section. The frame with captivated mask is mounted in spaced relationship to a phosphordot plate, and the combination is assembled into the tube as a package located adjacent to the faceplate ("Improvements in the RCA Three-Beam Shadow Mask Color Kinescope," by Grimes et al. The IRE, January 1954; decimal classification R583.6.).

OBJECTS OF THE INVENTION

It is a general object of this invention to provide means to facilitate the manufacture of color cathode ray tubes having a tensed foil shadow mask.

It is an object of this invention to provide improved fixturing means that will facilitate the manufacture of color cathode ray tubes having a tensed foil shadow mask.

It is another object of this invention to provide improved fixturing means for use in manufacturing an in-process assembly comprising a tensed foil in-process shadow mask and a faceplate.

It is a further object of this invention to provide a factory fixture frame including tensed foil in-process shadow mask clamping means for quickly and securely clamping and retaining a shadow mask under high tension without damage to the mask.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

DETAILED DESCRIPTION OF THE PREFERRED EMBODIMENT

To facilitate understanding of the factory fixture frame and its relation to the process of manufacturing a tensed mask cathode ray tube, copending application Ser. No. 051,896 filed May 18, 1987 is incorporated herein by reference. That application sets forth in detail the components of a factory fixture frame for an in-process tension mask color cathode ray tube and its relationship to the tube components.

Briefly, the factory fixture frame according to the invention of the aforementioned copending application provides for high precision in the registration and reregistration of a foil in-process shadow mask with a flat face plate during manufacture. The factory fixture frame is reusable and provides for the cementless and weldless quick-retention of an in-process shadow mask during fabrication of the associated color cathode ray tube. As described in detail therein, the factory fixture frame has first six-point indexing means on a first side for registration with complementary registration-affording means on an exposure lighthouse during manufacture of a color cathode ray tube. A second six-point indexing means is provided on a second, opposed side of the factory fixture frame for registration with complementary registration-affording means on an in-process faceplate. Therefore, the in-process shadow mask can be precisely registered and reregistered with the lighthouse and the in-process faceplate for the photoexposure of the faceplate while retaining the shadow mask in tension. The present invention is directed to a quick-release mechanical mask-retaining means for use on the reusable factory fixture frame to temporarily and removably support the in-process shadow mask in tension.

Figure 1:
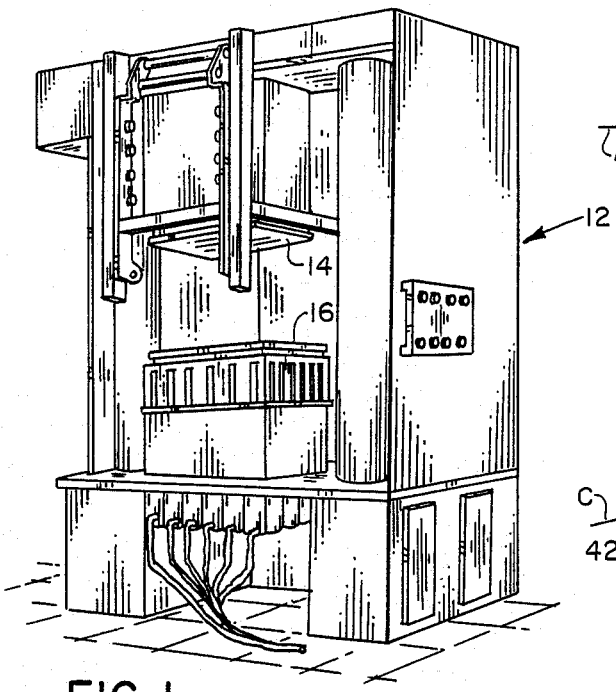
FIG. 1 is a view in elevation and in perspective of a mask tensing-clamping machine for receiving a factory fixture frame and mask retaining means according to the invention.

Referring generally to the drawings, FIG. 1 shows a mask tensing-clamping machine, generally designated 12, which provides for receiving the factory fixture frame which is loaded into the mask tensing-clamping machine by an operator. The machine has an upper platen 14 and a lower platen 16 which are heated to provide for expansion of the shadow mask blank prior to the clamping operation.

Figure 2:
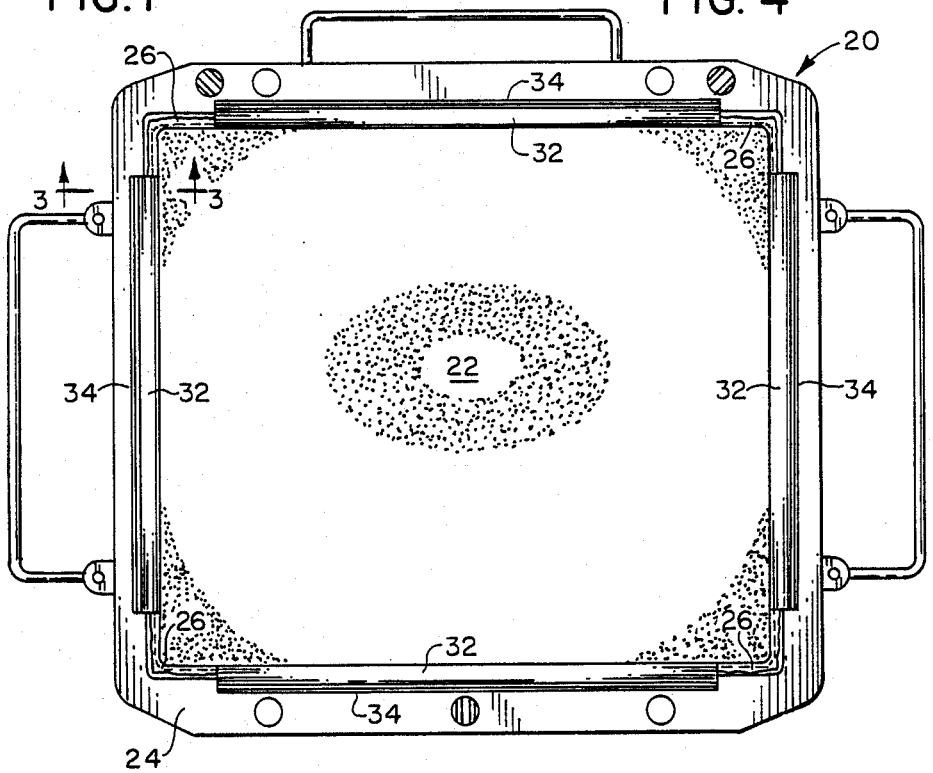
FIG. 2 is a plan view of a factory fixture frame according to the invention with peripheral recess means within which an in-process shadow mask is temporarily and removably supported in tension.

FIG. 2 shows a factory fixture frame, generally designated 20, for the high precision in registering and reregistering a foil in-process shadow mask with a faceplate during manufacture. More particularly (and as described in application Ser. No. 051,896), factory fixture frame 20 provides for mounting an in-process shadow mask 22 during photoexposure of an in-process faceplate in a lighthouse, and serves as a fixture for the process of welding and trimming the in-process mask. The factory fixture frame is reusable and comprises a generally rectangular frame means and quick-release mechanism mask-retaining means (described hereinafter) for temporarily and removably supporting an in-process shadow mask 22 in tension. Frame 20 is shown as supporting shadow mask 22 in tension. The factory fixture frame provides for the cementless and weldless quick-retention of in-process shadow mask 22 out of the plane of the mask. Without going into great detail, suffice it to say that factory fixture frame 20 includes receptacle means in the form of groove or recess means 24 (FIG. 2) for receiving an edge 26 of shadow mask 22 and within which the mask edge is clamped.

Mask tensing-clamping machine 12 (FIG. 1) receives factory fixture frame 20 which is loaded into the machine by an operator. The machine also provides for receiving shadow mask 22 in a free state between upper and lower platens 14 and 16, respectively. Generally, the platens are heated to provide for expansion of shadow mask 22 as the platens sandwich the mask therebetween. Edges 26 of the shadow mask are clamped into a recess means 24 while the shadow mask is heated. The shadow mask then is allowed to cool and shrink in tension while being temporarily and removably supported on frame 20 by the mask retaining means of the invention. The frame, with its tensed shadow mask, then is ready to be transported through other processing steps, such as the aforesaid photoexposure of an in-process faceplate in a lighthouse.

Figure 3:
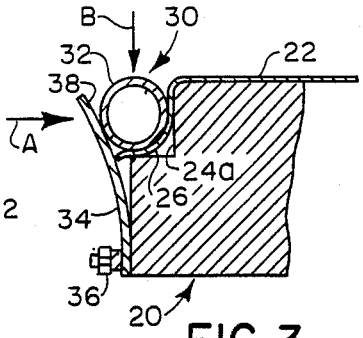
FIG. 3 is a fragmented section through a corner of the factory fixture frame, illustrating one embodiment of the mask-retaining means according to the invention.

FIG. 3 shows a fragmented section through a corner of factory fixture frame 20 illustrating one embodiment of the invention which includes a peripheral recess means in the form of a corner cutout **24*a* extending longitudinally along the outside of the fixture frame. A spring-loaded elongate means, generally designated 30, is positionable within cutout 24*a* to clamp edge 26 of shadow mask 22**.

More particularly, spring-loaded elongate means 30 include a rigid rod-like member 32 which is generally cylindrically shaped, which may be in the form of a tube and which complementarily mates within cutout **24*a*. A leaf spring 34 is secured to the outer periphery of fixture frame 20, as by fastening means 36, whereby the leaf spring is biased against the outside of rod 30, as at 38, in the direction of arrow "A". To this end, rod 32 preferably is of a greater diameter than the width of cutout 24*a* so that the leaf spring is cocked away from the side of the fixture frame when rod 32 is in position for clamping and temporarily and removably supporting an in-process shadow mask in tension. Leaf spring 34 may be elongated along cutout 24*a*, or a plurality of leaf springs may be spaced along the cutout for engaging rod 32**.

In operation, after shadow mask 22 is heated when sandwiched between upper and lower heated platens 14 and 16, respectively, the shadow mask is brought into generally coplanar position with the top of factory fixture frame 20, as seen in FIG. 3, with edges 26 overlying cutout **24*a*. Rod 32 then is moved in the direction of arrow "B" to wrap mask edge 26 around the corner of cutout 24*a* through a 180° wrap angle. Leaf spring 34 is effective to bias rod 32** against the mask edge to clamp the mask edge for temporarily and removably supporting the in-process shadow mask in tension after the shadow mask is allowed to cool and shrink in tension.

Figure 4:
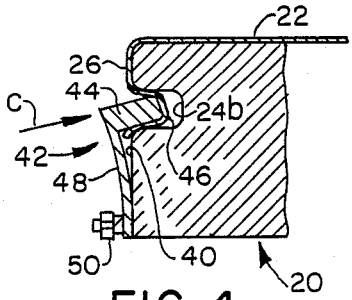
FIG. 4 is a view similar to that of FIG. 3, illustrating another embodiment of the mask-retaining means according to the invention.

FIG. 4 show another embodiment of the invention wherein the peripheral recess means 24 is in the form of a groove **24*b* disposed in an outer peripheral side 40 of factory fixture frame 20. It can be seen that edge 26 of shadow mask 22 is wrapped around the fixture frame through a wrap angle of 360° and is seated in groove 24*b*. The mask retaining means comprises a unitary retainer member, generally designated 42, for clamping mask edge 26 in groove 24*b*** to temporarily and removably support the in-process shadow mask in tension.

More particularly, retainer member 42 includes a rigid head portion 44 which is rounded at 46 to complementarily mate with groove **24*b* to sandwich mask edge 26 between head portion 44 and the interior of the groove. A leaf spring portion 48 extends from head portion 44 and is secured to the side of factory fixture frame by appropriate fastening means 50. Preferably, a plurality of the retainer members 42 are spaced longitudinally along groove means 24*b* along each side of the factory fixture frame. The leaf springs are effective to bias head portions 44 into groove 24*b*** in the direction of arrow "C".

The operation of the mask-retaining means shown in FIG. 4 is similar to the embodiment described above in relation to the mask-retaining means 30 of FIG. 3.

As disclosed in copending application Ser. No. 139,892, a tube is inserted in a groove with the resulting clamping force being established by deformation of the clamped tube due to the smaller cross-section of the groove relative to the tube. Such a system inherently is characterized by a high spring rate thus making the clamping force highly sensitive to dimensional variation as could arise from wear or manufacturing tolerances.

Relatively low spring rate requires substantial deflection to achieve a required load. As a result a minor change in deflection, due to wear does not significantly affect the magnitude of applied load.

As is known in the band brake art, increasing the wrap angle of a band around a curved surface results in a high tension rate between the leading and trailing ends of the band. This is effectively, a force multiplication device which, with respect to FIGS. 3 and 4, provides a high force reaction to the mask tension while requiring only a small clamping force at the distal end of the mask.

An advantage of wrap angle is to spread the clamping force over a larger surface area of the mask foil in order to minimize pinching forces which can cause local damage resulting in failure of the mask material at the clamping location.

As a result a very effective retention of a tensed mask is achieved with minimal damage to mask material and also minimal wear and minimal structure requirements for the clamping components.

Because the wrap angle is an exponential term in the force equation, increased wrap angles can result in very significant increases in force ratio.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. For use in the manufacture of a color cathode ray tube having a flat faceplate and a tensed foil shadow mask, a factory fixture frame for mounting an in-process shadow mask, the frame including peripheral elongate recess means for receiving an edge of the shadow mask, and mechanical mask-retaining means including elongate means positionable in said recess means for temporarily and removably supporting an in-process shadow mask in tension, and spring means being operatively associated between the frame and the elongate means for biasing the elongate means in clamping engagement with the edge of the shadow mask in the recess means.

2. The factory fixture frame of claim 1 wherein said elongate means comprise a rod-like member and said spring means comprise a leaf spring.

3. The factory fixture frame of claim 2 including a plurality of said leaf springs spaced longitudinally along the rod-like member.

4. The factory fixture frame of claim 2 wherein said recess means comprise a corner cutout in said frame and said leaf spring is secured to a side of the frame for biasing the rod-like member into the corner cutout against the edge of the shadow mask in a direction generally parallel to the flat faceplate.

5. The factory fixture frame of claim 2 wherein said rod-like member is generally cylindrical.

6. The factory fixture frame of claim 5 wherein said rod-like member comprises a tube.

7. For use in the manufacture of a color cathode ray tube having a flat faceplate and a tensed foil shadow mask, a factory fixture frame for mounting an in-process shadow mask, the frame including peripheral groove means in a side of the fixture frame for receiving an edge of the shadow mask, and mechanical mask-retaining means having at least a portion complementarily mating with said recess means in a biasing direction generally parallel to the flat faceplate for temporarily and removably supporting an in-process shadow mask in tension, the mechanical mask-retaining means being operatively spring loaded between the frame and said portion for biasing the portion in clamping engagement with the edge of the shadow mask in the groove means.

8. For use in the manufacture of a color cathode ray tube having a flat faceplate and a tensed foil shadow mask, a factory fixture frame for mounting an in-process shadow mask, the frame including peripheral elongate recess means for receiving an edge of the shadow mask, and mechanical mask-retaining means in the form of a generally cylindrical rod-like member extending lengthwise of said recess means and a leaf spring operatively associated between the frame and the rod-like member for biasing the rod-like member in clamping engagement with the edge of the shadow mask disposed in said recess means for temporarily and removably supporting an in-process shadow mask in tension.

9. The factory fixture frame of claim 8 wherein said rod-like member is generally cylindrical.

10. The factory fixture frame of claim 9 wherein said rod-like member comprises a tube.

11. For use in the manufacture of a color cathode ray tube having a flat faceplate and a tensed foil shadow mask, a factory fixture frame for mounting an in-process shadow mask, the frame including peripheral elongate recess means for receiving an edge of the shadow mask, and mechanical mask-retaining means in the form of a rod-like member complementarily mating with said recess means and spring means operatively associated between the frame and the rod-like member for biasing the rod-like member into the recess means in clamping engagement with the edge of the shadow mask for temporarily and removably supporting an in-process shadow mask in tension.

12. The factory fixture frame of claim 11 wherein said rod-like member is generally cylindrical and said spring means comprise a leaf spring.

13. The factory fixture frame of claim 12 including a plurality of said leaf springs spaced longitudinally along the rod-like member.

14. The factory fixture frame of claim 13 wherein said rod-like member is generally cylindrical.

15. The factory fixture frame of claim 14 wherein said rod-like member comprises a tube.

16. For use in the manufacture of a color cathode ray tube having a flat faceplate and a tensed foil shadow mask, a factory fixture frame for mounting an in-process shadow mask, the frame including peripheral groove means in a side of the fixture frame for receiving an edge of the shadow mask, and mechanical mask-retaining means having at least a portion complementarily mating with said groove means for temporarily and removably supporting an in-process shadow mask in tension, the mechanical mask-retaining means being operatively spring loaded between the frame and said portion for biasing the portion in clamping engagement with the edge of the shadow mask in the groove means.

17. The factory fixture frame of claim 16 wherein said mask-retaining means comprises a unitary retaining member with said portion comprising a head portion complementarily mating with said groove means, and a leaf spring portion secured to the side of the fixture frame.

18. The factory fixture frame of claim 17 wherein said head portion is rounded.

19. The factory fixture frame of claim 17 including a plurality of said retainer members spaced longitudinally along the groove means.

20. A process for use in the manufacture of a color cathode ray tube having a flat faceplate and a tensed foil shadow mask, comprising:

providing a factory fixture frame for mounting an in-process shadow mask, the fixture frame having peripheral recess means for receiving an edge of the shadow mask, the recess means at least in part opening on a side of the fixture frame; and temporarily and removably supporting an in-process shadow mask in tension on said frame by spring-loaded mechanical mask-retaining means mating with said recess means biasing against the edge of the shadow mask in a direction generally parallel to the flat faceplate.

21. The process of claim 20 wherein said shadow mask is heated and allowed to expand prior to being temporarily and removably supported on said frame.

22. The process of claim 21 wherein said shadow mask is allowed to cool and shrink in tension while being temporarily and removably supported on said frame.

23. The process of claim 22, including the step of positioning an edge portion of the shadow mask over at least a portion of the recess means prior to said supporting step.

* * * * *